US007210960B2

(12) United States Patent
Mak

(10) Patent No.: US 7,210,960 B2
(45) Date of Patent: May 1, 2007

(54) EXTENSION CORD AND METHOD OF MANUFACTURING THE SAME

(76) Inventor: Raymond wai-man Mak, 12/F Metropolitan Ind'l & Warehouse Bldg., 216-218, Texaco Road Tsuen Wan, N.T., Hong Kong (HK)

( * ) Notice: Subject to any disclaimer, the term of this patent is extended or adjusted under 35 U.S.C. 154(b) by 0 days.

(21) Appl. No.: 11/194,364

(22) Filed: Aug. 1, 2005

(65) Prior Publication Data

US 2007/0026728 A1 Feb. 1, 2007

(51) Int. Cl.
*H01R 11/00* (2006.01)

(52) U.S. Cl. ..... 439/505

(58) Field of Classification Search ..... 439/505, 439/106, 639, 502, 214, 265
See application file for complete search history.

(56) References Cited

U.S. PATENT DOCUMENTS

| | | | | |
|---|---|---|---|---|
| 2,979,624 | A * | 4/1961 | Wilby | 307/38 |
| 5,236,374 | A | 8/1993 | Leonard et al. | |
| 5,352,132 | A | 10/1994 | O'Keefe | |
| 5,788,521 | A * | 8/1998 | Milan | 439/214 |
| D408,354 | S * | 4/1999 | Whitcomb | D13/137.4 |
| 5,902,148 | A * | 5/1999 | O'Rourke | 439/505 |
| 6,663,396 | B1 * | 12/2003 | Wang | 439/31 |
| 6,676,428 | B2 * | 1/2004 | Burton | 439/270 |
| 6,752,653 | B1 | 6/2004 | Morlock et al. | |
| 6,764,322 | B1 * | 7/2004 | Yu | 439/137 |
| 6,837,751 | B2 * | 1/2005 | Vanden Wymelenberg et al. | 439/701 |
| 6,897,379 | B1 | 5/2005 | Hsiao | |
| 6,940,015 | B2 * | 9/2005 | Fang | 174/53 |

* cited by examiner

*Primary Examiner*—Neil Abrams
*Assistant Examiner*—Phuongchi Nguyen
(74) *Attorney, Agent, or Firm*—Tianhua Gu; Global IP Services

(57) ABSTRACT

A new extension cord and its manufacturing method. The new extension cord has a plurality of sockets at intervals along its longitude direction so as to reduce the whole length of extension cord and increase the number of the sockets. The jacks of sockets are protected by caps to avoid occurrence of electricity shock and water entry into the sockets. The manufacturing method comprises steps of forming a plug, forming a plurality of sockets, forming electrical cords, disposed the sockets at intervals along a longitude direction of the electrical cord. The steps of forming each of the electrical cords comprise forming at least two electrical wires, forming an insulated wrap to enclose the conducting wires, welding the plug and the sockets to form an integral piece by ultrasonic wave.

6 Claims, 6 Drawing Sheets

EXTENSION CORD AND METHOD OF MANUFACTURING THE SAME

FIELD OF THE INVENTION

The invention relates to electrical equipments and more particularly to extension cords and manufacturing methods thereof.

BACKGROUND OF THE INVENTION

Along with worldwide applications of electrical appliances, extension cords become essential components in the electrical appliances, such as sockets and plugs. Conventional sockets and plugs are generally independent components with single function. People must resort to multi-functional socket to satisfy requirements of users when plurals of electrical device need socket at the same time. Furthermore, because conventional socket has its jacks exposed outside and without shield, there is a fear to get an electric shock or have water entry into the socket.

Hence, it is desired to provide safe and multi-sectional extension cords to satisfy user's various requirements.

SUMMARY OF THE INVENTION

To overcome the drawbacks of prior arts, a main object of the present invention is to provide an extension cord which has a plurality of sockets at intervals along its longitude direction so as to reduce the whole length of extension cord and increase the number of the sockets and thus satisfy various requirements of users.

Another object of the present invention is to provide an extension cord which has at least one socket with jacks, wherein the jacks are protected by caps to avoid occurrence of electricity shock and water entry into the socket.

The present invention further provides a method of manufacturing such extension cords.

To achieve the objects, an extension cord of the present invention comprising: a male plug; at least two conducting wires electrically connecting with the plug; and a plurality of female sockets disposed at intervals along a longitude direction of the conducting wires; each conducting wire electrically connecting with each socket; wherein the plugs and the sockets are both in an integral piece. In the invention, each of the sockets comprises a plurality of caps, springs corresponding to jacks of the socket, and a mooring plate to hold the caps and the springs. A projecting portion is formed on one end of each socket and a socket switch is provided on the projecting portion; a handle is selectively provided on the plug and/or the socket. The socket switch is one of remote switch, time-control switch, light-sensitive control and induction control switch. A switch trip is provided on each socket adjacent to the socket switch. The sockets are shunt-wound, at least one of which has the caps. In an embodiment, the male plug comprises a base portion and a head portion connected with the base portion in a pivot structure. In a further embodiment, the male plug comprises an expansile grounding pin which can be controlled by a handle.

A method of manufacturing an extension cord, comprising the steps of: forming a plug; forming a plurality of sockets; forming at least one electrical cords; and disposed the sockets at intervals along a longitude direction of the electrical cord; wherein forming each of the electrical cords comprising: forming at least two electrical wires; and forming an insulated wrap to enclose the conducting wires; the plug and the sockets are all welded by ultrasonic wave to form an integral piece. In the invention, forming the plug comprising the steps of: forming an enclosure constituted by at least two parts; and a plurality of conducting terminals; assembling the parts of the enclosure and the conducting terminals together; welding the above components to form an integral structure by ultrasonic wave. Forming the socket comprises: forming an enclosure constituted by two parts, a face plate and a plurality of conducting terminals; forming a socket switch and a switch trip; assembling the above components together; welding the above components together to form an integral structure by ultrasonic wave. Manufacturing the socket further comprises the steps of: forming a plurality of caps and spring corresponding to jacks of the socket; fixing the caps and the springs on the mooring plate; attaching the caps to the socket.

Compared the present invention with the prior arts, an extension cord of the invention comprises a plurality of sockets in series connection or parallel connection with a male plug so as to reduce the total length of conducting wire and increase the number of the sockets, thus satisfying the various requirements of the users. In addition, the caps are provided for the socket to cover the jacks of the socket so as to prevent from electricity shock and water entry into the socket.

For the purpose of making the invention easier to be understood, some particular embodiments thereof will now be described with reference to the appended drawings in which:

DETAILED DESCRIPTION OF THE INVENTION

An extension cord of the present invention comprises a male plug, a plurality of female sockets and conducting wires. Each conducting wire is electrically connected with the male plug in one end and connected with the female socket in the other end. In another embodiment, both ends of each conducting wire are electrically connected with the female sockets that are provided at intervals along a longitude direction of the conducting wire so as to form an extension cord of the invention.

Figure 2:
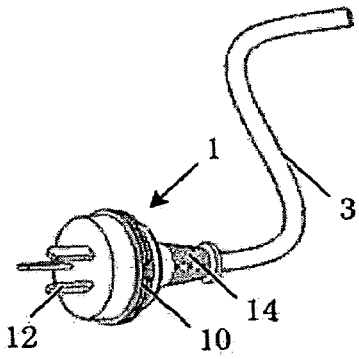
FIG. 2 is a schematic view of the male plug of the extension cord in FIG. 1.
Figure 3:
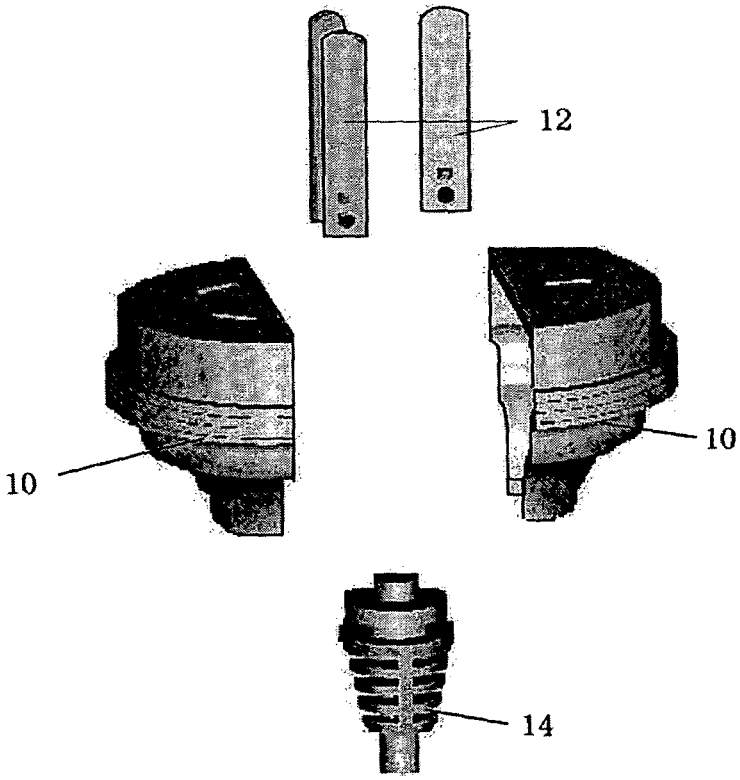
FIG. 3 is an exploded, perspective view of the male plug in FIG. 2.

FIG. 2 is a schematic view of a male plug of the extension cord of the present invention. FIG. 3 is an exploded, perspective view of the male plug in FIG. 2. In the present invention, as shown in FIG. 2 and FIG. 3, the male plug 1 comprises an enclosure 10, a plurality of conducting terminals 12 and a cord buckle 14. The conducting terminals 12 are embedded in the enclosure 10 and extending outwardly from the enclosure 10. In the present invention, the terminals 12 and the enclosure 10 are in an integral piece. In addition, the plug 1 has its bottom connect with the cord buckle 14 integrally, and the cord buckle 14 has its end connected with the conducting wire 3, thus connecting the plug 1 and the conducting wire 3 integrally by the cord buckle 14.

Figure 1:
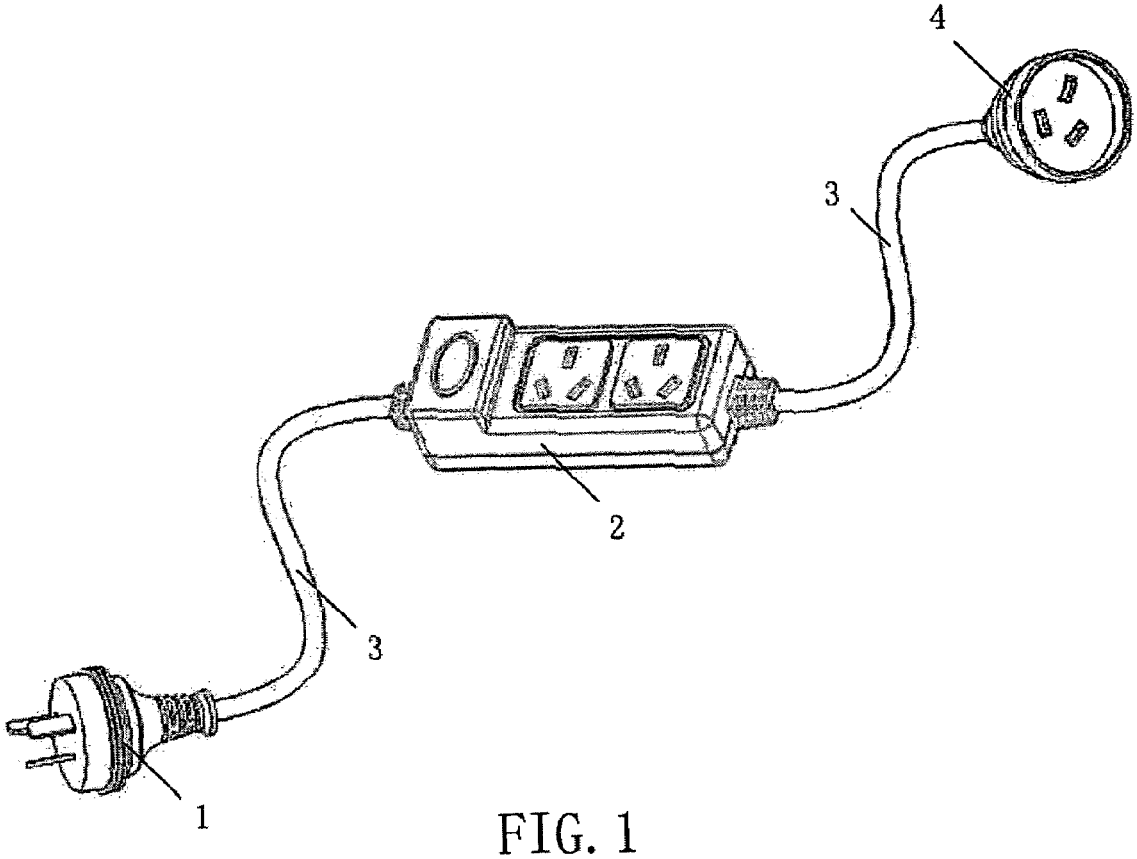
FIG. 1 is a schematic view of an extension cord according to a first embodiment of the present invention.
Figure 4:
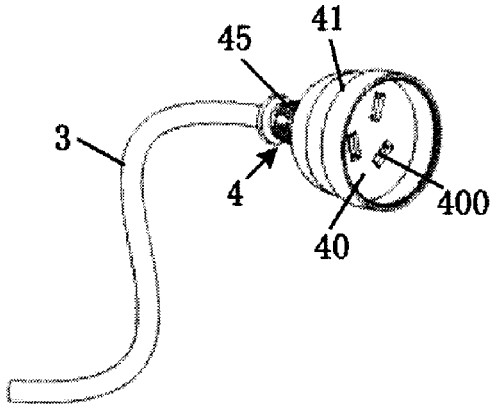
FIG. 4 is a schematic view of a socket of the extension cord in FIG. 1 according to a first embodiment of the present invention.
Figure 5:
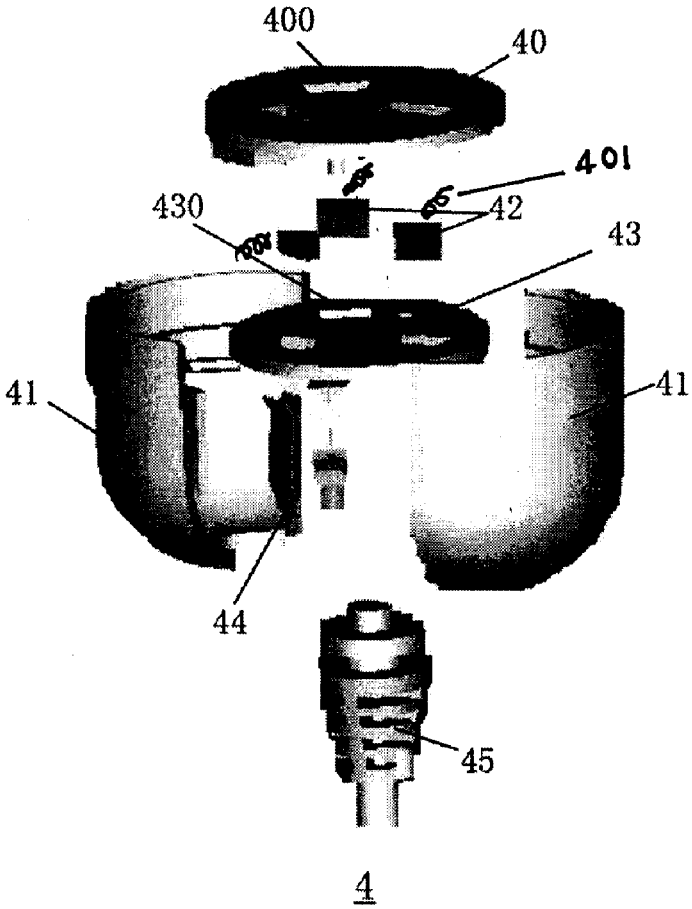
FIG. 5 is an exploded, perspective view of the socket in FIG. 4.

FIG. 4 is the schematic view of the socket of the extension cord in FIG. 1 according to a first embodiment of the present invention; FIG. 5 is the exploded, perspective view of the socket in FIG. 4. As shown in FIG. 4 and FIG. 5, in female sockets according to a first embodiment of the present invention, the socket 4 comprises a face plate 40 and a housing 41. A plurality of throughholes 400 are provided on the face plate 40, and the plurality of the conducting terminals 12 (shown in FIG. 3) of the male plug 1 are provided corresponding to the throughholes 400 of the male plug 4. The face plate 40 and the housing 41 are disassembled integral pieces.

In the embodiment as shown in FIG. 5, the socket 4 also includes a plurality of caps 42, a plurality of spring 401 and a mooring plate 43, hardware terminals 44 and a cord buckle 45. The caps 42, springs 401, the mooring plate 43, the hardware terminals 44 are all held in a cavity of the female socket 4. Among them, the caps 42 and the springs 401 are arranged corresponding to the throughholes 400. Each spring 401 is mounted on the cap 42. The caps 42 and the springs 401 can be selectively moved to seal or open the throughholes 400. A plurality of throughholes 430 is formed on the mooring plate 43 corresponding to the throughholes 400 on the face plate 40. The caps 42 and the springs 401 are fixed on the bottom of the face plate 40 by the mooring plate 400. The hardware terminals 44 are provided corresponding to the throughholes 430 on mooring plate 43, thus making the terminals of the male plug extend through the throughholes 400 on the face plate 40 and the throughholes 430 on the mooring plate 43 in turn, and then be inserted in slots of the hardware terminals 44. The hardware terminals 44 comprise ground wire terminal, neutral wire terminal and live wire terminal. The cord buckle 45 is integrally connected with the bottom of the socket 4.

Referring to FIGS. 1–5, during operation, the terminals 12 of the male plug 1 are inserted into the throughholes 400 of the female socket 4 to push the caps 42 to compress the springs, so as to make it contact with the hardware terminals 44 in the female socket 4, thus an electrical connection between the male plug 1 and the female socket 4 is attained. When the extension cord is pulled out, the caps 42 moves back under the relapse strength of the springs to seal the throughholes 430 on the mooring plate 43, so avoiding occurrence of electricity shock and water entry into the socket.

Figure 6:
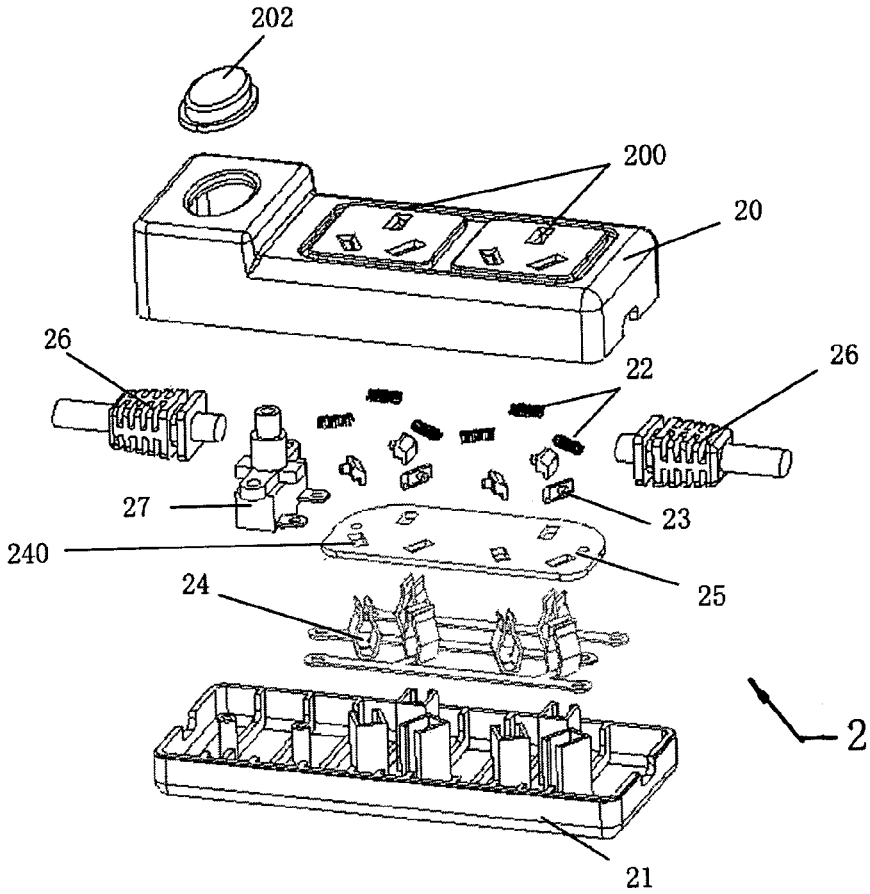
FIG. 6 is an exploded, perspective view of a socket of the extension cord in FIG. 1 according to a second embodiment of the present invention.

FIG. 6 is an exploded, perspective view of a second embodiment of the male plug of the extension cord of the present invention. In the embodiment as shown in FIG. 6, the female socket 2 comprises a face plate 20 and an enclosure 21, and a plurality of throughholes 200 are arranged on the face plate 20, a plurality of conducting terminals 12 of the male plug 1 are arranged corresponding to the plurality of throughholes 200 of the female socket 2. The face plate 20 and the shell 21 are integrally formed.

Referring to FIG. 6, the female socket 2 also includes a plurality of springs 22, a plurality of caps 23, a mooring plate 25, hardware terminals 24 and a plurality of cord buckles 26. Among them, the springs 22, the caps 23, the mooring plate 25 and the hardware terminals 24 are all held in cavity of the female socket 2. The springs 22 and the plurality of caps 23 are arranged corresponding to the plurality of throughholes 200, each of the springs 22 is disposed on the cap 23. The springs 22 and the caps 23 can be selectively moved to seal or open the throughholes 200. A plurality of throughholes 240 are formed on the mooring plate 25 corresponding to the throughholes 200 of the face plate 20. The springs 22 and the plurality of caps 23 are fixed on the back of the face plate 20 by the mooring plate 25. The hardware terminals 24 are provided corresponding to the throughholes 240 of the mooring plate 25, thus making the terminals of the male plug get through the throughholes 200 on the face plate 20 and the throughholes 240 on the mooring plate 25 in turn, and then be inserted in a slot of hardware terminals 24. The hardware terminals 24 comprise a ground wire terminal, a neutral wire terminal and a live wire terminal. The cord buckle 26 and bottom of socket 2 are integrally formed.

Furthermore, in the embodiment, the female socket 2 further includes a socket switch 202 and a switch trip 27. The socket switch 202 is provided on the face plate 20 for controlling the electrical connection between the male plug 1 and the female socket 2. The switch trip 27 is provided in a cavity constituted by the face plate 20 and the enclosure 21. The socket switch 202 and the switch trip 27 can contact in discontinuity. The principle of electrical operation of the female socket 2 is similar to that of the female socket 4, so a detailed description is omitted herefrom. The only difference between the female socket 4 and the female socket 2 is that the socket 2 further includes the socket switch 202 and the switch trip 27. When power source is required to switch-on, it is only required to insert the male plug 1 into the female socket 2 firstly, and then press down the socket switch 202 to push the switch trip 27 downwardly, thus an electrical connection between the male plug 1 and the female socket 2 is completed. When the power source is required to switch-off, it is only required to press down the socket switch 202 again, then the electrical connection between the male plug 1 and the female socket 2 will be cut off so as to protect the female socket on occasion of forgetting to pull the male plug out.

It can be understood that the socket switch of the invention can be optional among remote switch, time-control switch, light-sensitive control and induction control switch.

To facilitate pulling the male plug out of the female socket, a handle can be provided on the male plug and the female socket, it can achieve the effect of laborsaving and electricity proof for the user to pull out male plug through holding the handle of male plug or female socket.

A method of manufacturing an extension cord of the invention comprises the following steps: firstly, forming a plug 1, a socket 2 and at least an electrical cords; secondly, provided a plurality of sockets 2 at intervals along a longitude direction of the electrical cord; and lastly, welding the plug 1 and the socket 2 to form an integral structure thereof by ultrasonic wave. In the invention, forming each electrical cord includes forming at least two conducting wires and an insulated wrap to enclose the conducting wires.

In one embodiment of the invention, a method of manufacturing the male plug 1 includes the following steps: first, forming an enclosure 10 constituted by at least two parts and a plurality of conducting terminals 12; then, assembling the parts of the enclosure 10 and the conducting terminals 12 together; lastly, welding the above components to form an integral structure by ultrasonic wave.

A method of manufacturing the socket 2 comprises the following steps: first, forming an enclosure 21 constituted by two parts, a face plate 20 and a plurality of hardware terminals 24; next, forming a socket switch 202 and a switch trip 27; then assembling the above components together; lastly, welding the above components together to form an integral structure by ultrasonic wave.

In another embodiment of the invention, a step of manufacturing a socket 2 with caps 23 further comprises the steps of: forming a plurality of caps 23 and spring 22 corresponding to the throughholes 200 of the socket 2 firstly; secondly, fixing the caps 23 and the springs 22 on the mooring plate 25; lastly, attached them into the socket 2.

An extension cord of the invention can be assembled by the aforementioned male plugs and female sockets or conventional male plugs and female sockets, the invention will be illustrated through the following embodiments.

THE FIRST EMBODIMENT

FIG. 1 is a schematic view of a first embodiment of the extension cord of the present invention. As shown in FIG. 1, in a first embodiment of the invention, an extension cord of the present invention comprises a male plug 1, a plurality of female sockets 2, 4 and a plurality of conducting wires 3. A sectional conducting wire 3 is electrically connected with the male plug 1 in one end and connected with the female socket 2 in the other end; the female sockets 2 and 4 are provided at intervals along a longitude direction of the conducting wire 3 to form an extension cord of the invention.

THE SECOND EMBODIMENT

Figure 7:
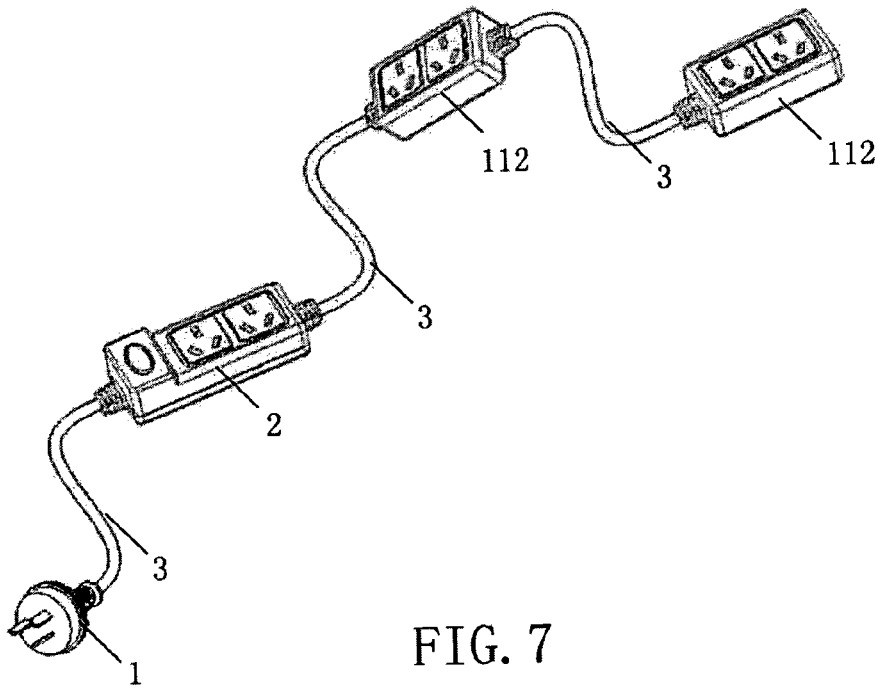
FIG. 7 is a schematic view of an extension cord according to a second embodiment of the present invention.

FIG. 7 is a schematic view of a second embodiment of the extension cord of the present invention. As shown in FIG. 7, in the second embodiment of the invention, an extension cord comprises a male plug 1, female sockets 2, 112, 112 and a plurality of conducting wires 3. Similar to the first embodiment shown in FIG. 1, the female socket 2 and two other sockets 112 are provided along a longitude direction of the conducting wire 3, which is electrically connected to each female socket. Obviously, the numerals and kinds of the sockets are not limited to the embodiments in the invention. It can be achieved that electrical coupling of several female sockets only by connecting a male plug with power source.

THE THIRD EMBODIMENT

Figure 8:
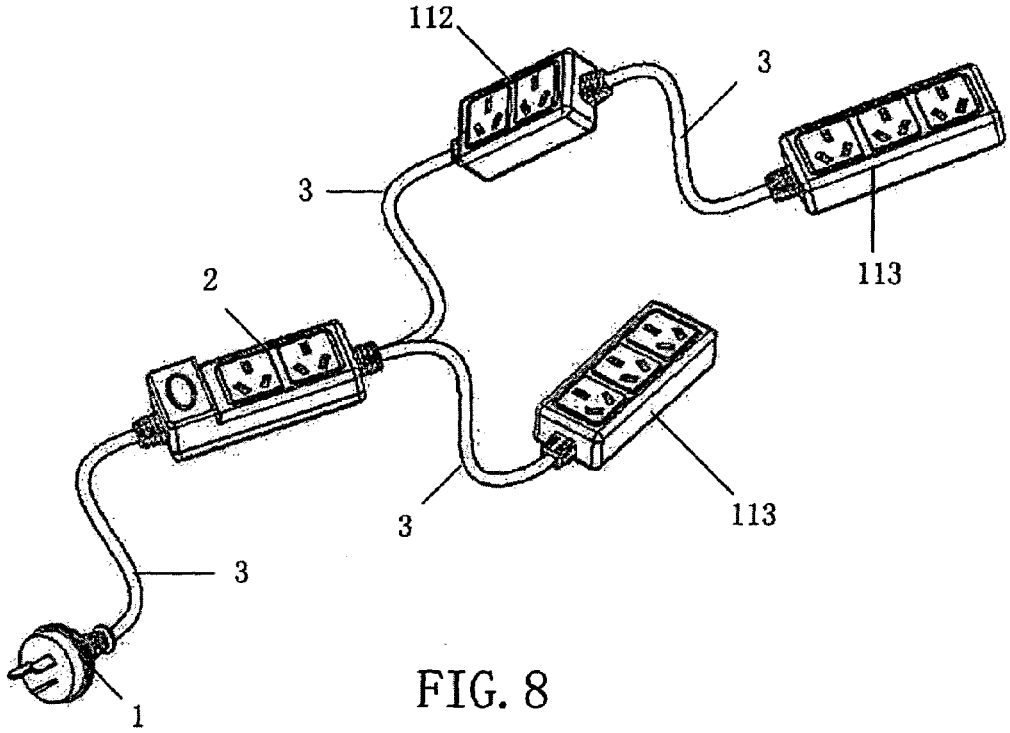
FIG. 8 is a schematic view of an extension cord according to a third embodiment of the present invention.

FIG. 8 is a schematic view of a third embodiment of the extension cord of the present invention. As shown in FIG. 8, an extension cord comprises a male plug 1, a plurality of female sockets 2, 112, 113 and a plurality of the conducting wires 3. In the embodiment, the connecting method of the plug with the sockets is similar to that of the first and second embodiment. The sockets are provided at intervals along the length of the conducting wire 3. The plurality of conducting wires are educed from one female socket to make series connection or parallel connection for the several female sockets, thus reducing the whole length of the conducting wires and increasing the number of female sockets.

THE FOURTH EMBODIMENT

Figure 9:
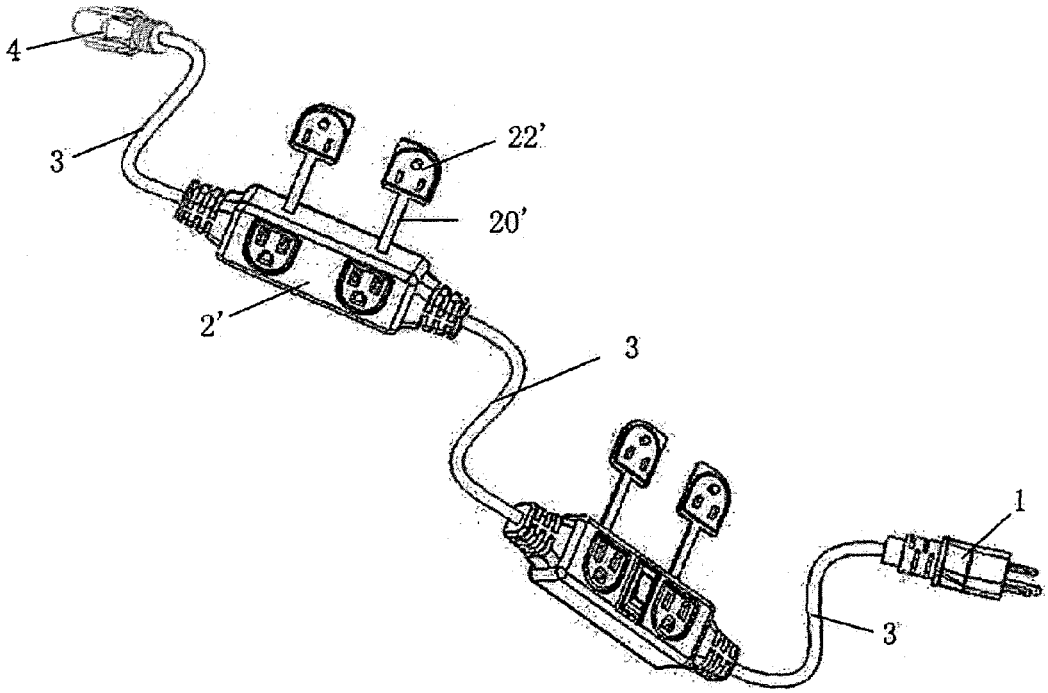
FIG. 9 is a schematic view of an extension cord according to a fourth embodiment of the present invention.

FIG. 9 is a schematic view of a fourth embodiment of the extension cord of the present invention. As shown in FIG. 9, an extension cord comprises a male plug 1, a plurality of female sockets 4, 2', 2' and a plurality of conducting wires 3. In this embodiment, caps 22' are provided on each female socket 2'. The caps 22' are connected with the body of the female socket 2' by connecting bars 20'. When the female socket is not in use, the caps 22' can be shut to protect the jacks of the female socket 2', thus avoiding occurrence of electricity shock and water entry into the socket.

THE FIFTH EMBODIMENT

Figure 10:
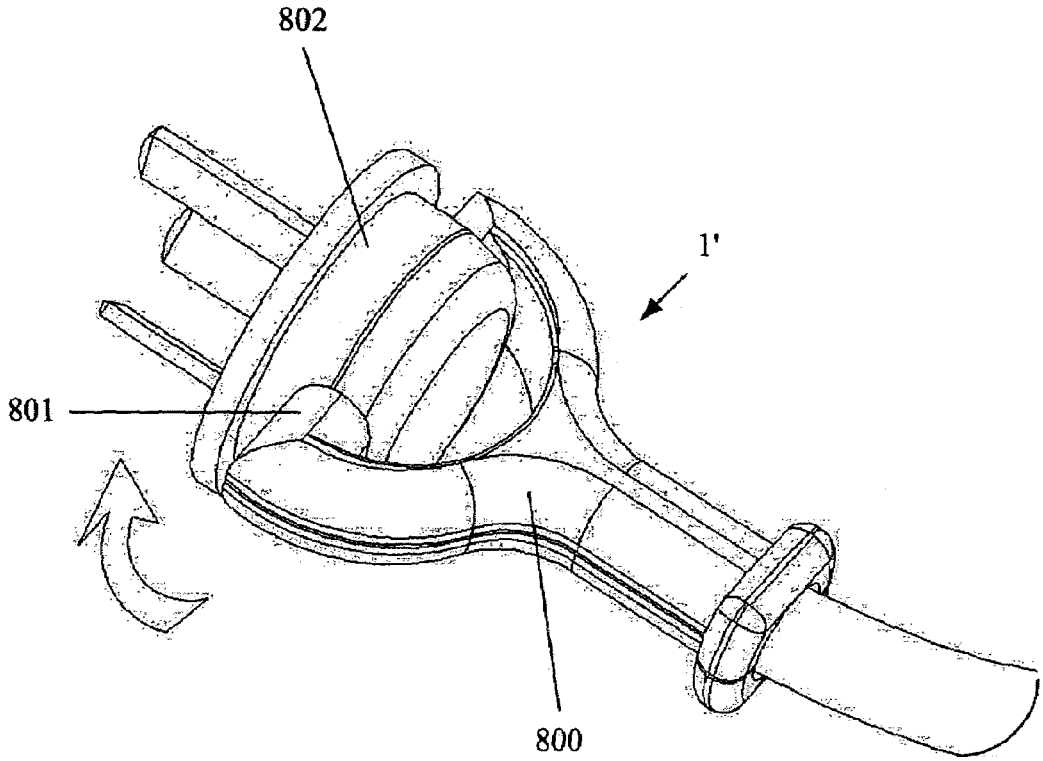
FIG. 10 is a schematic view of a male plug of an extension cord according to a fifth embodiment of the present invention.

FIG. 10 is a schematic view of a fifth embodiment of the present invention. As shown in FIG. 10, a male plug 1' of the invention comprises a base portion 800 and a head portion 802 connected with the base portion 800 in a pivot structure 801 so that the head portion 802 can be rotated in the pivot structure 801, which is as a pivot relative to the base portion 800.

THE SIXTH EMBODIMENT

Figure 11:
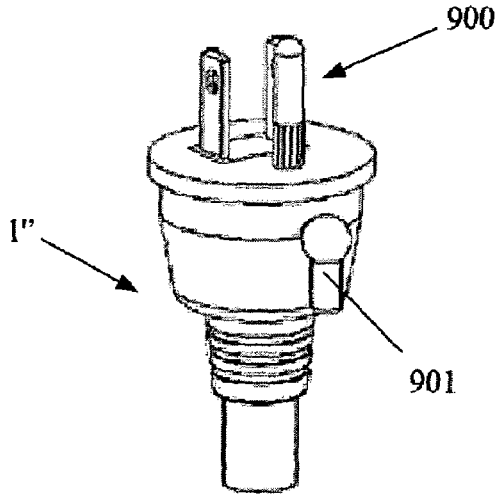
FIGS. 11–12 are schematic views of a male plug of an extension cord according to a sixth embodiment of the present invention.
Figure 12:
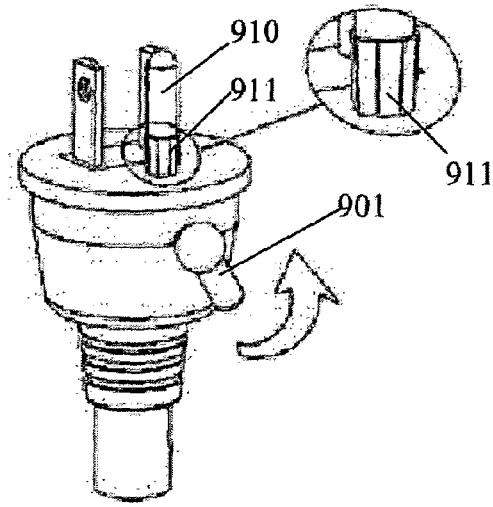

FIGS. 11–12 are schematic views of a sixth embodiment of the present invention. As shown in FIGS. 11–12, the male plug 1" comprise an expansile grounding pin 900 which can be controlled by a handle 901. In the embodiment, the grounding pin 900 comprises a terminal portion 910 and a connection portion 911. When the handle 901 is rotated, it will drive the terminal portion 910 to press the connection portion 911, and then the connection portion 911 expands under the pressure of the terminal portion 910. Thus, when the male plug 1" is inserted into a socket, a firm engagement therebetween will be attained by rotating the handle 901.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. An extension cord comprising:

a plug;

conducting wires electrically connecting with said plug;

a plurality of sockets disposed at intervals along a longitude direction of said conducting wires; each said conducting wire electrically connecting with each said socket;

said plug comprising terminals, an enclosure, a bottom and a cord buckle, which are sealed in an integral piece by welding for protecting its inner part from water and for safety;

said socket comprising a face plate, a shell, and a cord buckle, which are sealed in an integral piece by welding for protecting its inner part from humidity and for safety;

wherein the number of said conducting wires is two;

wherein said socket comprises a plurality of caps, springs corresponding to through holes of said socket, and a mooring plate to hold said caps and said springs, said caps move back to seal the through holes under the pressures of said springs when said plug is pulled out from said socket, thereby said socket is safer for users and is easier for putting said plug into said socket;

wherein a projecting portion is formed on one end of each said socket, a socket switch is provided on a face plate, a switch trip is sealed in said projecting portion under said socket switch by welding, said socket switch which contacts user's finger can contact said switch trip which connects electrical power in discontinuity, thereby safe structure and safe operation are achieved.

2. The extension cord as claimed in claim 1, wherein said socket switch is one of remote switch, time-control switch, light-sensitive control and induction control switch.

3. The extension cord as claimed in claim 1, wherein said sockets are shunt-wound, a plurality of conducting wires are educed from one said female socket to make series connection or parallel connection for the several said female sockets, thus reducing the whole length of the conducting wires and increasing the number of said female sockets.

4. The extension cord as claimed in claim 1, wherein said plug comprises a base portion and a head portion connected with said base portion in a pivot structure.

5. The extension cord as claimed in claim 1, wherein said plug comprises an expansible grounding pin, which comprises a terminal portion, a connection portion and a handle, said handle can rotate to drive said terminal portion to press said connection portion, said connection portion is expanded under the pressure of said terminal portion for tight connection between said grounding pin with said socket.

6. The extension cord as claimed in claim 1, wherein said welding is ultrasonic wave welding.

* * * * *